US011117240B2

(12) United States Patent
Watanabe

(10) Patent No.: US 11,117,240 B2
(45) Date of Patent: Sep. 14, 2021

(54) GRINDING APPARATUS AND GRINDING METHOD

(71) Applicant: JTEKT CORPORATION, Osaka (JP)

(72) Inventor: Akira Watanabe, Chiryu (JP)

(73) Assignee: JTEKT CORPORATION, Osaka (JP)

( * ) Notice: Subject to any disclaimer, the term of this patent is extended or adjusted under 35 U.S.C. 154(b) by 762 days.

(21) Appl. No.: 15/858,198

(22) Filed: Dec. 29, 2017

(65) Prior Publication Data

US 2018/0193978 A1 Jul. 12, 2018

(30) Foreign Application Priority Data

Jan. 6, 2017 (JP) ..... JP2017-001301

(51) Int. Cl.
*B24B 41/06* (2012.01)
*B24B 5/04* (2006.01)
(Continued)

(52) U.S. Cl.
CPC ..... *B24B 41/062* (2013.01); *B24B 5/04* (2013.01); *B24B 5/045* (2013.01); *B24B 19/125* (2013.01);
(Continued)

(58) Field of Classification Search
CPC ..... B24B 41/062; B24B 5/04; B24B 5/045; B24B 19/125; B24B 49/003; B24B 49/10; B24B 49/16
(Continued)

(56) References Cited

U.S. PATENT DOCUMENTS 4,507,896 A * 4/1985 Smith ..... B24B 5/22 451/242
8,517,797 B2 * 8/2013 Kumeno ..... B24B 49/16 451/5
(Continued)

FOREIGN PATENT DOCUMENTS

CN 104271315 A 1/2015
JP 5402347 1/2014

OTHER PUBLICATIONS

Combined Chinese Office Action and Search Report dated Dec. 16, 2020 in Patent Application No. 201711477627.6 (with English translation of Category of Cited Documents), 9 pages.

*Primary Examiner* — Michael D Jennings
*Assistant Examiner* — Alberto Saenz
(74) *Attorney, Agent, or Firm* — Oblon, McClelland, Maier & Neustadt, L.L.P.

(57) ABSTRACT

A grinding apparatus grinds a workpiece by rotating the workpiece held by main spindles and a grinding wheel held by a wheel spindle, and by relatively moving the grinding wheel toward and away from the workpiece. The grinding apparatus includes a first detection unit that detects a rotational phase of the workpiece; a second detection unit that detects a grinding resistance moment at a grinding point between the grinding wheel and the workpiece, or detects a drive current of a rotary drive unit of the workpiece or a rotary drive unit of the grinding wheel; a storage unit that stores the grinding resistance moment or the drive current in a manner associated with the rotational phase; and a determination unit that determines a slip between the workpiece and the main spindles based on the grinding resistance moment or the drive current at a current rotational phase,
(Continued)

and on the grinding resistance moment or the drive current at the same phase as the current rotational phase of a previous time.

8 Claims, 13 Drawing Sheets

(51) Int. Cl.
*B24B 49/16* (2006.01)
*B24B 49/10* (2006.01)
*B24B 49/00* (2012.01)
*B24B 19/12* (2006.01)

(52) U.S. Cl.
CPC ..... *B24B 49/003* (2013.01); *B24B 49/10* (2013.01); *B24B 49/16* (2013.01)

(58) Field of Classification Search
USPC ..... 451/5, 8, 9, 10, 11, 14, 17, 49, 243
See application file for complete search history.

(56) References Cited

U.S. PATENT DOCUMENTS

| | | | | |
|---|---|---|---|---|
| 9,033,762 | B2 * | 5/2015 | Makiuchi | B24B 41/062 451/5 |
| 2012/0129433 | A1 | 5/2012 | Makiuchi | |
| 2012/0164920 | A1 * | 6/2012 | Kumeno | B24B 19/125 451/11 |

* cited by examiner

GRINDING APPARATUS AND GRINDING METHOD

INCORPORATION BY REFERENCE

The disclosure of Japanese Patent Application No. 2017-001301 filed on Jan. 6, 2017 including the specification, drawings and abstract, is incorporated herein by reference in its entirety.

BACKGROUND OF THE INVENTION

1. Field of the Invention

The present invention relates to a grinding apparatus and a grinding method.

2. Description of Related Art

Some grinding apparatuses employ a drive system in which both end faces of a workpiece are pressed to be held by centers provided on main spindles, and rotation of the centers is transmitted to the workpiece with frictional forces associated with pressing forces of the centers. Other grinding apparatuses employ a drive system in which a circumferential surface of the workpiece is pressed to be held by a chuck or a work carry provided on a main spindle, and rotation of the chuck or the work carry is transmitted to the workpiece with a frictional force associated with pressing force of the chuck or the work carry.

As illustrated in FIGS. 10A and 10B, in the grinding apparatuses employing such drive systems, if a wheel spindle motive force for a grinding wheel G or a main spindle motive force for a workpiece W (a moment Fn.Rg), hereinafter referred to as a "grinding resistance moment Mn", represented by a tangential grinding resistance Fn at a grinding point Pg and a distance Rg between the grinding point Pg and a rotational center Cg of the grinding wheel G exceeds a holding force for the workpiece W (a moment F.Rw), hereinafter referred to as a "frictional force moment Mm", represented by a frictional force F between a center C and a center hole H and a distance Rw between a frictional force generation point Pf (for convenience, assumed to be a middle point in the radial direction of a frictional portion between the center C and the center hole H) and a rotational center Cw of the workpiece W during the grinding, slip occurs between the workpiece W and the main spindle (the center, the chuck, or the work carry), and the workpiece W could result in a defective product. Due to this, in the grinding apparatuses, grinding conditions are determined so that the grinding resistance moment Mn does not exceed the frictional force moment Mm.

For example, Japanese Patent No. 5402347 (JP 5402347) describes a grinding apparatus that can prevent slip between a workpiece and main spindles from occurring. This grinding apparatus detects a limit current value of a main spindle drive motor at which the slip occurs between the workpiece and the main spindles before performing grinding, and changes the grinding conditions when a motor current value has reached a threshold set based on the limit current value during the grinding.

Since the threshold of the motor current value varies depending on the size of the workpiece and varies between rough grinding and precision grinding that differ from each other in infeed rate, the setting of the threshold needs to be changed depending on the case. However, the grinding apparatus described in JP 5402347 mentioned above controls the grinding by setting a constant threshold, and consequently, cannot determine the occurrence of the slip between the workpiece and the main spindles, in some cases.

SUMMARY OF THE INVENTION

It is an object of the present invention to provide a grinding apparatus and a grinding method that are capable of reliably determining the occurrence of the slip between the workpiece and the main spindles.

A grinding apparatus according to an aspect of the present invention is a grinding apparatus that grinds a workpiece by rotating the workpiece held by main spindles and a grinding wheel held by a wheel spindle, and by relatively moving the grinding wheel toward and away from the workpiece.

The grinding apparatus includes:

a first detection unit that detects a rotational phase of the workpiece;

a second detection unit that detects a grinding resistance moment at a grinding point between the grinding wheel and the workpiece, or detects a drive current of a rotary drive unit of the workpiece or a rotary drive unit of the grinding wheel;

a storage unit that stores the grinding resistance moment or the drive current in a manner associated with the rotational phase; and a determination unit that determines a slip between the workpiece and the main spindles based on the grinding resistance moment or the drive current at a current rotational phase, and on the grinding resistance moment or the drive current at the same phase as the current rotational phase of a previous time.

In the grinding operation, when the grinding wheel held on the wheel spindle stock is infed into the workpiece at a constant feed rate of the wheel spindle stock, the grinding resistance moment or the drive current for each rotational angle of the workpiece tends to rise before settling and tends to remain at the same level after settling, if the slip does not occur between the workpiece and the main spindles. Since the grinding apparatus of the present aspect monitors the grinding resistance moment or the drive current for each rotational phase (angle) of the workpiece, the occurrence of the slip between the workpiece and the main spindles can be reliably determined. Consequently, a defective product of the workpiece can be prevented from flowing out, and the safety margin for the grinding conditions can be reduced to shorten the machining time.

A grinding method according to another aspect of the present invention is a grinding method for grinding a workpiece by rotating the workpiece held by main spindles and a grinding wheel held by a wheel spindle, and by relatively moving the grinding wheel toward and away from the workpiece.

The grinding method includes:

a first detection step of detecting a rotational phase of the workpiece;

a second detection step of detecting a grinding resistance moment at a grinding point between the grinding wheel and the workpiece, or detecting a drive current of a rotary drive unit of the workpiece or a rotary drive unit of the grinding wheel;

a storage step of storing the grinding resistance moment or the drive current in a manner associated with the rotational phase; and a determination step of determining a slip between the workpiece and the main spindles based on the grinding resistance moment or the drive current at a current rotational phase, and on the grinding resistance moment or the drive current at the same phase as the current rotational phase of a previous time. According to the grinding method of the above-described aspect, the same effects as the effects of the grinding apparatus described above can be obtained.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
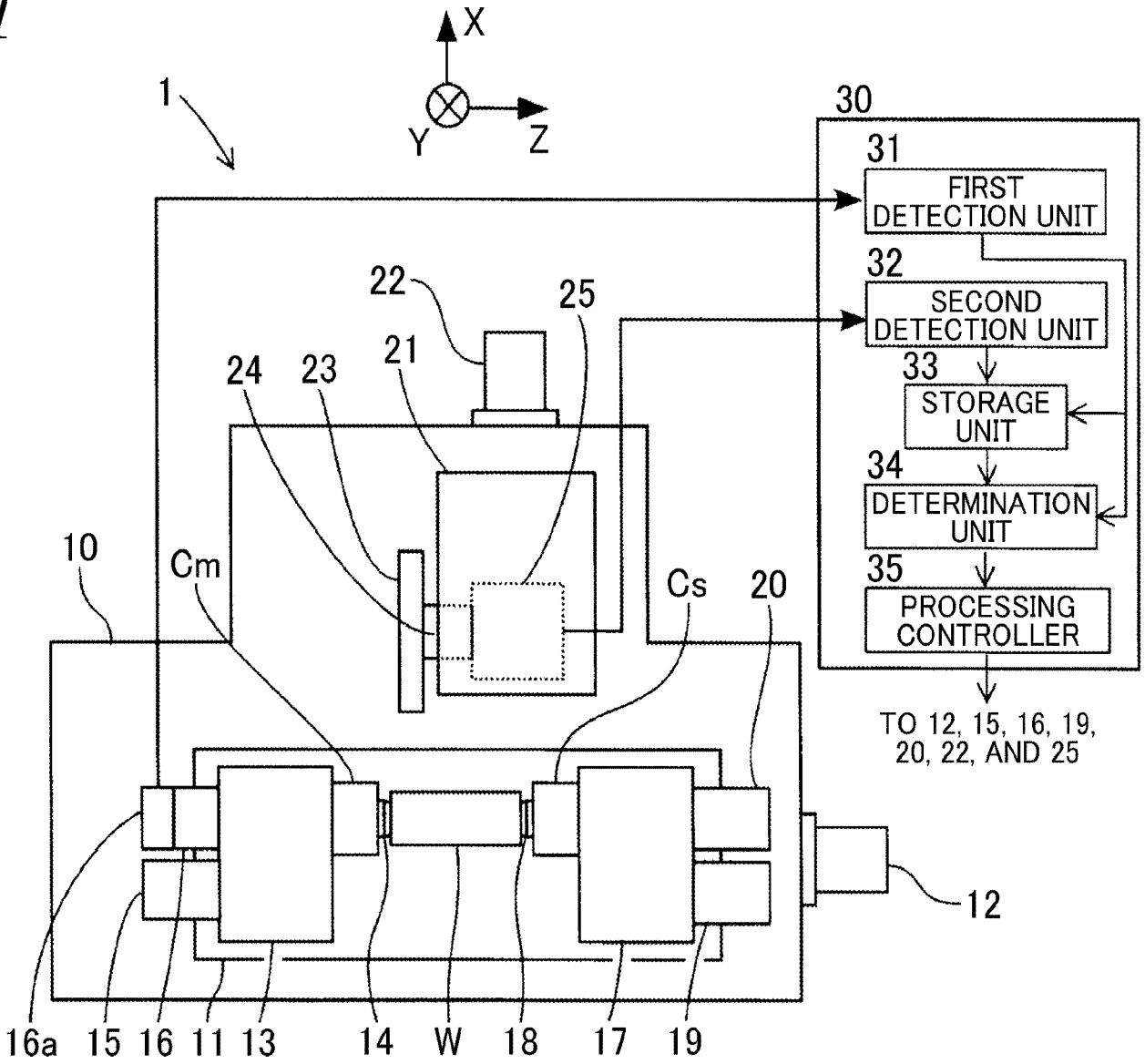
FIG. 1 is a plan view of a grinding apparatus in an embodiment of the present invention.

The following describes a wheel spindle stock traverse cylindrical grinding apparatus as an example of a grinding apparatus of an embodiment of the present invention. As illustrated in FIG. 1, a grinding apparatus 1 includes, for example, a bed 10, a table 11, a headstock 13, a tailstock 17, a wheel spindle stock 21, and a control device 30.

The table 11 is guidingly supported on the bed 10 so as to be movable in the Z-axis direction (right-left direction in FIG. 1) by a Z-axis servo motor 12. The headstock 13 for rotatably pivotally supporting a master spindle Cm is placed on the table 11. A center 14 (holding unit) for supporting an end of a workpiece W is mounted at a distal end of the master spindle Cm. The master spindle Cm is advanced and retreated by a predetermined amount in the axis line direction thereof by an advance/retreat drive device 15, and is rotationally driven by a master servo motor 16 (rotary drive unit).

In addition, the tailstock 17 is placed on the table 11 at a location facing the headstock 13. A slave spindle Cs is rotatably pivotally supported on the tailstock 17 so as to be coaxial with the master spindle Cm. A center 18 (holding unit) for supporting the other end of the workpiece W is mounted at a distal end of the slave spindle Cs. The slave spindle Cs is reciprocated in the axis line direction thereof by a servo motor 19 for controlling a center pressing force, and is rotationally driven by a slave servo motor 20 (rotary drive unit) in synchronization with the master spindle Cm.

The wheel spindle stock 21 is guidingly supported in a rear side position of the table 11 on the bed 10 so as to be movable in the X-axis direction (upper-lower direction in FIG. 1) orthogonal to the Z-axis direction by an X-axis servo motor 22. A grinding wheel 23 is pivotally supported on the wheel spindle stock 21 via a wheel spindle 24 that is rotatable about an axis line parallel to the Z-axis direction, and is rotationally driven by a wheel spindle drive motor 25 (rotary drive unit).

The control device 30 includes a first detection unit 31, a second detection unit 32, a storage unit 33, a determination unit 34, and a processing controller 35.

The first detection unit 31 detects a rotational phase of the workpiece W based on a phase detection signal from a rotary encoder 16*a* provided in the master servo motor 16.

The second detection unit 32 detects a drive current signal from the wheel spindle drive motor 25, and obtains a grinding resistance moment at a grinding point (contact point) between the grinding wheel 23 and the workpiece W based on the detected drive current signal. The second detection unit 32 stores in advance a table representing a relation between the drive current signal and the grinding resistance moment increasing with increase in the drive current signal that have been measured in advance. After the drive current signal of the wheel spindle drive motor 25 is detected, the second detection unit 32 obtains the corresponding grinding resistance moment with reference to the table described above. The detected drive current signal may be directly used without being converted into the grinding resistance moment.

The storage unit 33 stores the grinding resistance moment obtained by the second detection unit 32 (or the drive current signal) in a manner associated with the rotational phase of the workpiece W detected by the first detection unit 31.

The determination unit 34 reads, from the storage unit 33, the grinding resistance moment (or drive current signal) obtained at the same phase as the current rotational phase of the workpiece W one rotation before. Although the details will be described later, the determination unit 34 determines whether a slip has occurred between the workpiece W and the master spindle Cm (center 14) based on the current grinding resistance moment (or drive current signal) and the grinding resistance moment (or drive current signal) obtained one rotation before.

The processing controller 35 grinds the workpiece W by controlling operations of the Z-axis servo motor 12, the advance/retreat drive device 15, the master servo motor 16, the servo motor 19, the slave servo motor 20, the X-axis servo motor 22, and the wheel spindle drive motor 25.

Figure 3A:
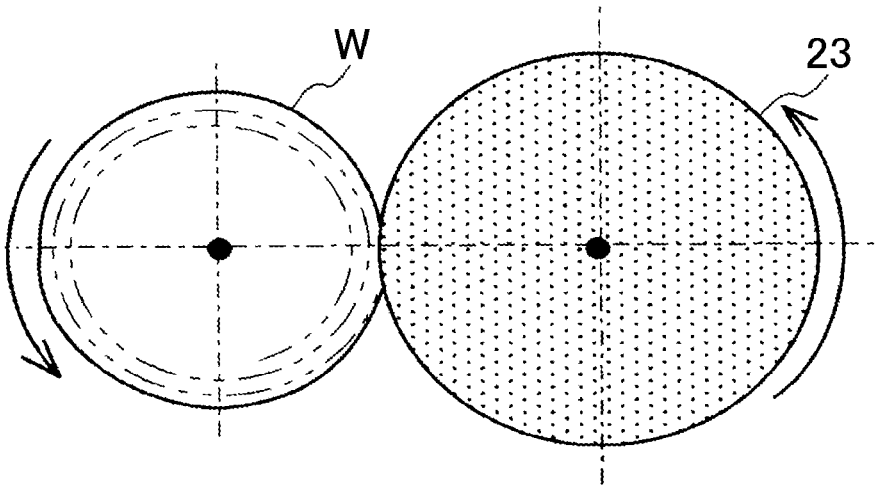
FIG. 3A is a diagram illustrating a workpiece and a grinding wheel in a grinding process using a spiral cycle performed in the grinding apparatus.
Figure 3B:
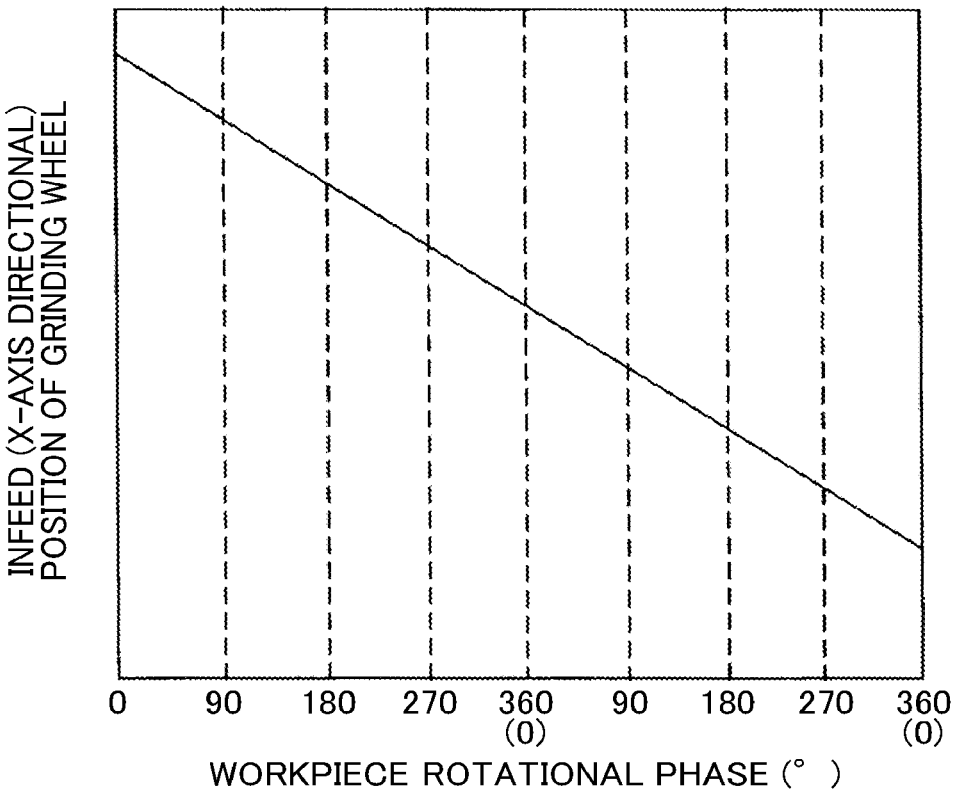
FIG. 3B is a diagram illustrating a relation between an infeed position of the grinding wheel and a rotational phase of the workpiece in the grinding process using the spiral cycle performed in the grinding apparatus.

The following describes a determination method of the slip occurring between the workpiece W and the master spindle Cm (center 14) (hereinafter simply referred to as "slip"). As described in the background of the invention, since the slip occurs when the grinding resistance moment Mn exceeds the frictional force moment Mm, discussion will be made regarding a temporal change in the grinding resistance moment Mn in the grinding process. In the grinding process in this case, as illustrated in FIG. 3A, the workpiece W having a circular section is ground using a spiral cycle, that is, using a cycle in which the infeed position (in the X-axis direction) of the grinding wheel 23 has a proportional relation with the rotational phase (angle) of the workpiece W, as illustrated in FIG. 3B.

Figure 4:
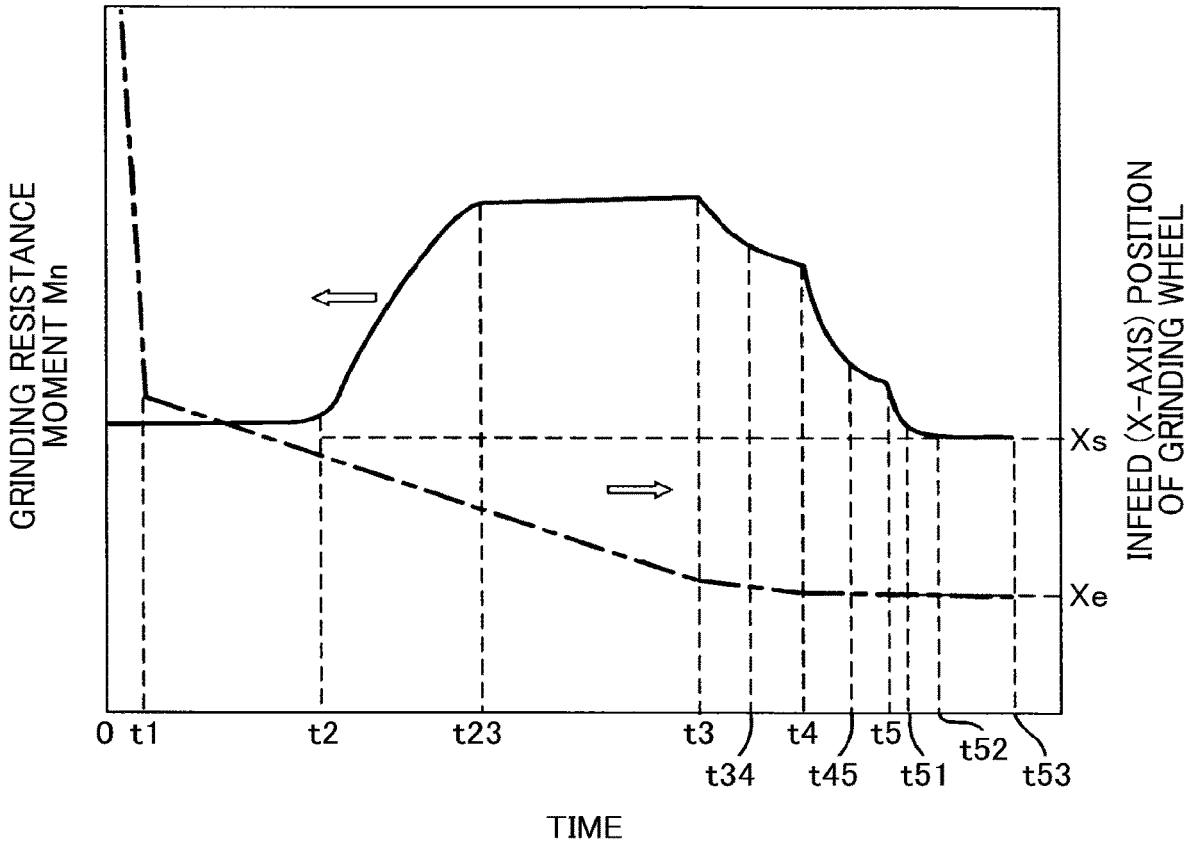
FIG. 4 is a diagram illustrating temporal changes in a grinding resistance moment and the infeed position of the grinding wheel when no slip occurs in the grinding process.

The description will first be given of the temporal change in the grinding resistance moment Mn when the slip does not occur. FIG. 4 illustrates a relation between the infeed position (in the X-axis direction) of the grinding wheel 23 and time (indicated by a long dashed short dashed line in FIG. 4) and a relation between the grinding resistance moment Mn and time (indicated by a continuous line in FIG. 4). A period from time 0 to time t1 corresponds to an idle grinding operation in which the grinding wheel 23 is rapidly fed until immediately before the grinding wheel 23 comes in contact with the workpiece W. A period from time t1 to time t3 corresponds to a rough grinding process in which the grinding wheel 23 is fed at an infeed rate V1. A period from time t3 to time t4 corresponds to a precision grinding process in which the grinding wheel 23 is fed at an infeed rate V2 smaller than the infeed rate V1. A period from time t4 to time t5 corresponds to a fine grinding process in which the grinding wheel 23 is fed at an infeed rate V3 smaller than the infeed rate V2. A period from time t5 to time t53 corresponds to a spark-out process.

In the rough grinding process, the actual infeed amount per unit time of the grinding wheel 23 increases from time t2 to time t23, and the actual infeed amount per unit time of the grinding wheel 23 remains constant from time t23 to time t3. In the precision grinding process, the actual infeed amount per unit time of the grinding wheel 23 decreases from time t3 to time t34, and the actual infeed amount per unit time of the grinding wheel 23 comes closer to constant from time t34 to time t4. In the fine grinding process, the actual infeed amount per unit time of the grinding wheel 23 decreases from time t4 to time t45, and the actual infeed amount per unit time of the grinding wheel 23 comes closer to constant from time t45 to time t5.

In the spark-out process, the actual infeed amount per unit time of the grinding wheel 23 decreases from time t5 to time t51, the actual infeed amount per unit time of the grinding wheel 23 comes closer to constant from time t51 to time t52; and the actual infeed amount per unit time of the grinding wheel 23 remains zero from time t52 to time t53. The grinding wheel 23 has a constant rotational speed during the rough grinding process, the precision grinding process, the fine grinding process, and the spark-out process.

As illustrated in FIG. 4, the grinding wheel 23 moves forward in the X-axis direction toward the workpiece W to start the rough grinding process (at time t1 in FIG. 4), and after coming in contact with the workpiece W at a location Xs, performs the rough grinding (at time t2 in FIG. 4). During the rough grinding, the grinding resistance moment Mn rapidly increases and then settles. Then, the grinding wheel 23 is shifted to the precision grinding (at time t3 in FIG. 4), and the grinding resistance moment Mn slowly drops at this time. Then, the grinding wheel 23 is shifted to the fine grinding (at time t4 in FIG. 4), and at this time, the grinding resistance moment Mn drops more rapidly than in the precision grinding. Then, the grinding wheel 23 ends the fine grinding at a location Xe (at time t5 in FIG. 4). The workpiece W judged as a good product can be obtained by the above-described grinding.

Figure 5:
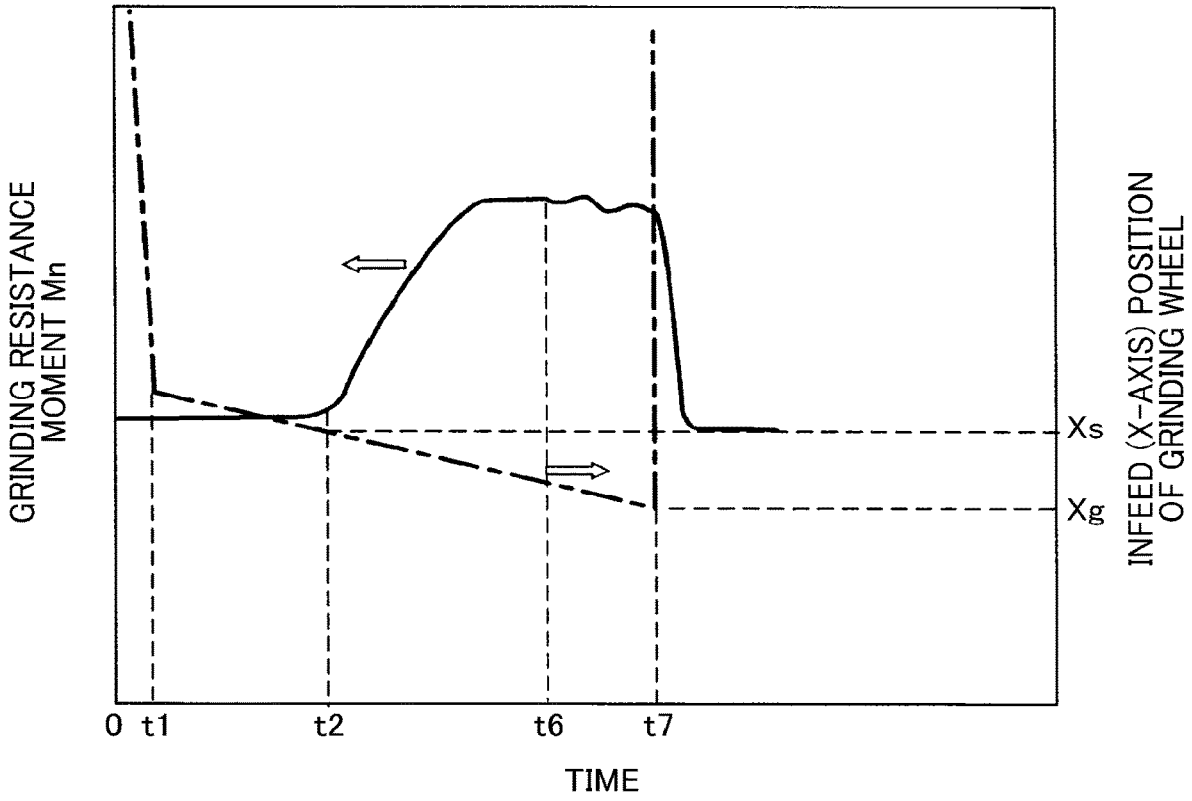
FIG. 5 is a diagram illustrating the temporal changes in the grinding resistance moment and the infeed position of the grinding wheel when slip occurs in the grinding process.

The following describes the temporal change in the grinding resistance moment Mn when the slip occurs. As illustrated in FIG. 5, the grinding wheel 23 moves forward in the X-axis direction toward the workpiece W to start the rough grinding process (at time t1 in FIG. 5), and after coming in contact with the workpiece W at the location Xs, performs the rough grinding (at time t2 in FIG. 5). During the rough grinding, the grinding resistance moment Mn rapidly increases and then settles.

Although being the same as in FIG. 4 up to this time point, the grinding resistance moment Mn is destabilized and starts to drop (from time t6 to t7 in FIG. 5) during the rough grinding. At this time, the slip is generated on the workpiece W. At time t7 in FIG. 5, the grinding wheel 23 moves backward from the workpiece W to abort the grinding. As described above, when the grinding resistance moment Mn is destabilized and starts to drop, the slip can be determined to have occurred between the workpiece W and the master spindle Cm (center 14). However, the following problem was found to be present.

Figure 6:
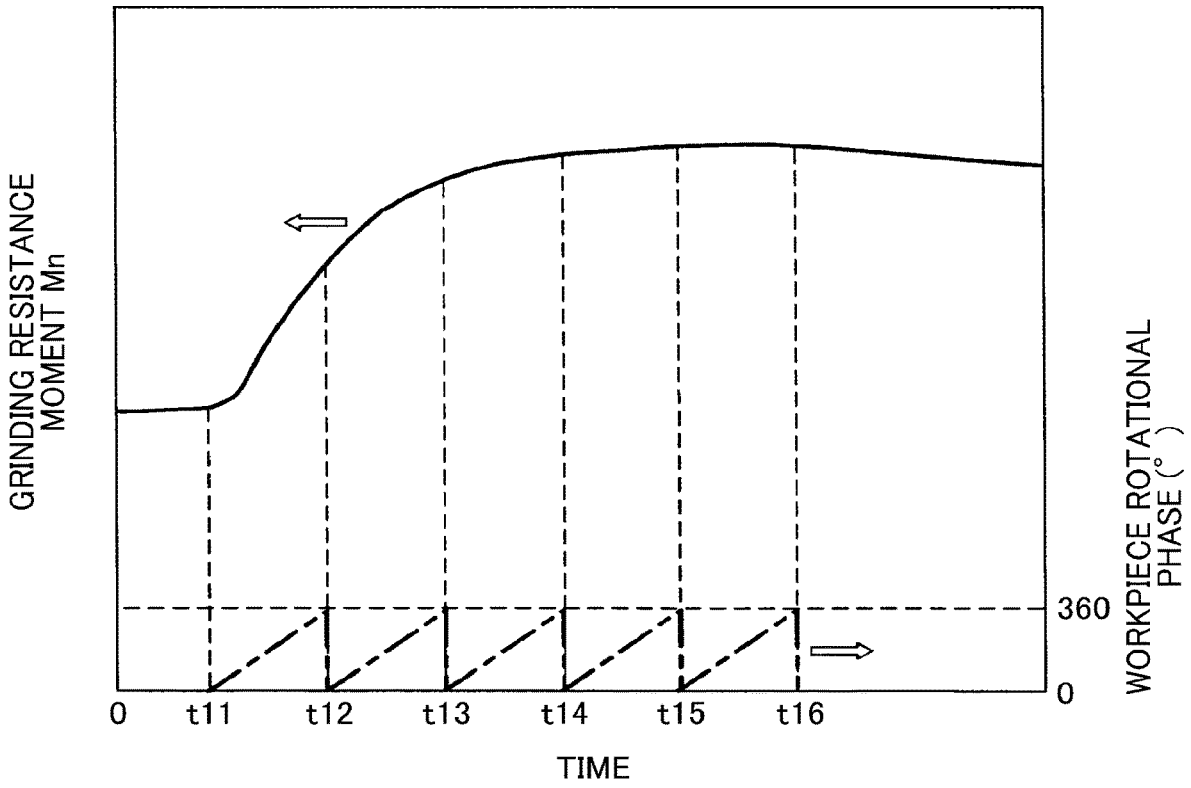
FIG. 6 is a diagram illustrating the temporal change in the grinding resistance moment for each rotation of the workpiece when the workpiece is held in an ideal state with no run-out at all.

That is, if the workpiece W is held in an ideal state with no run-out at all between the centers 14 and 18, the grinding resistance moment Mn continues to rise from a first rotation (from time t11 to t12 in FIG. 6) to a fifth rotation (from time t15 to t16 in FIG. 6) of the workpiece W, and then settles, as illustrated in FIG. 6. The reason why the grinding resistance moment Mn drops after the fifth rotation is that the workpiece W decreases in diameter, and thus, the amount of work done by the grinding wheel 23 decreases.

In the actual workpiece W, however, a run-out of the outer circumference of the workpiece W is present with respect to center holes. Consequently, the grinding resistance moment Mn fluctuates up and down each time the workpiece W makes one rotation (from 0 degrees to 360 degrees in the rotational phase (angle)). Thus, the inventors of the present invention focused attention on the fact that, when the grinding wheel 23 held on the wheel spindle stock 21 is infed into the workpiece W at a constant feed rate of the wheel spindle stock 21, the grinding resistance moment Mn for each rotation of the workpiece W tends to rise before settling and tends to remain at the same level after settling, if the slip does not occur. Although the following description is given of the grinding resistance moment Mn before settling, the same description applies to the grinding resistance moment Mn after settling.

Figure 7A:
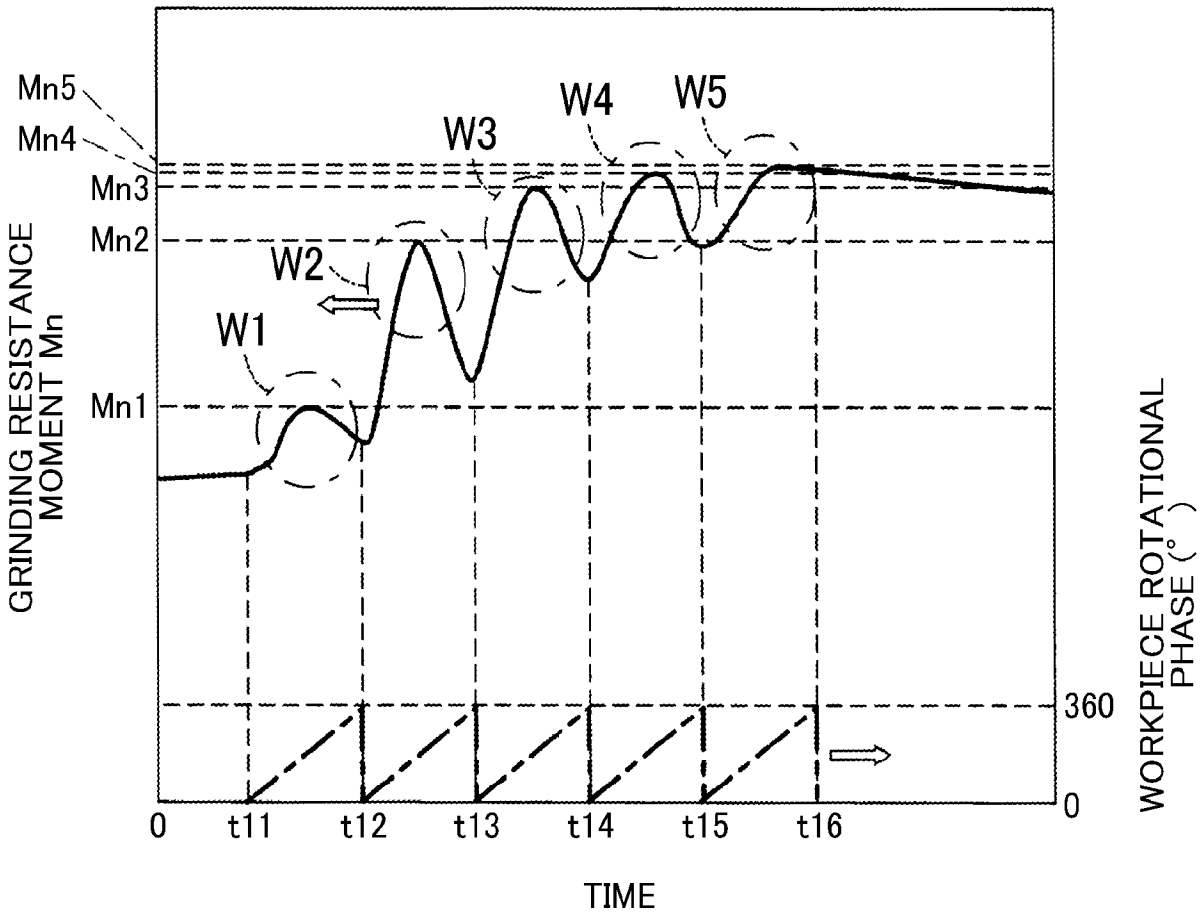
FIG. 7A is a diagram illustrating the temporal change in the grinding resistance moment for each rotation of the workpiece when no slip occurs.
Figure 7B:
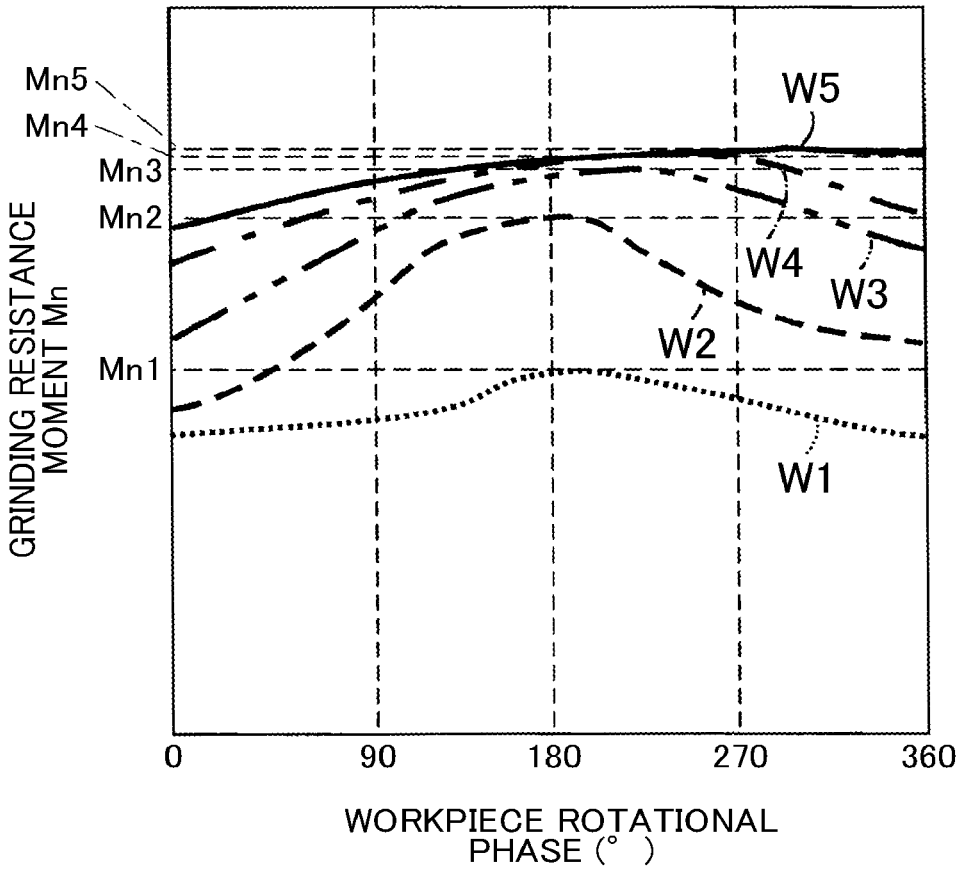
FIG. 7B is a diagram illustrating the temporal change in the grinding resistance moment for each rotational phase (angle) of the workpiece when no slip occurs.

The description will first be given of the temporal change in the grinding resistance moment Mn for each rotation and for each rotational phase (angle) of the workpiece W when the slip does not occur. As illustrated in FIGS. 7A and 7B, when the workpiece W makes the first rotation (along W1 from time t11 to t12 in FIG. 7A), the grinding resistance moment Mn once rises (until a rotational angle of approximately 180 degrees is reached), and then drops (along W1 indicated by a dotted line in FIG. 7B).

That is, while the infeed rate of the grinding wheel 23 is constant during the rough grinding process, at the beginning of the infeed operation, the actual infeed amount per unit time is very small at a place where the run-out of the outer circumference of the workpiece W is large, and the actual infeed amount per unit time is almost zero at a place where the run-out of the outer circumference of the workpiece W is small. Then, at the time of a slight amount of infeed, the actual infeed amount per unit time is large at a place where the run-out of the outer circumference of the workpiece W is large, and the actual infeed amount per unit time is very small at a place where the run-out of the outer circumference of the workpiece W is small.

When the workpiece W makes the second rotation (along W2 from time t12 to t13 in FIG. 7A), the amount of infeed increases, and thus, the actual infeed amount per unit time increases. Consequently, the grinding resistance moment Mn once rises to a value Mn2 larger than a peak value Mn1 of the grinding resistance moment Mn in the first rotation (until a rotational angle of approximately 180 degrees is reached), and then drops (along W2 indicated by a dashed line in FIG. 7B).

In the same manner, when the workpiece W makes the third and fourth rotations (along W3 from time t13 to t14 in FIG. 7A and W4 from time t14 to t15 in FIG. 7A), the amount of infeed further increases, and thus, the actual infeed amount per unit time increases. Consequently, the grinding resistance moment Mn once rises to values Mn3 and Mn4 larger than previous peak values Mn2 and Mn3 of the grinding resistance moment Mn (until a rotational angle of approximately 220 degrees is reached, and until a rotational angle of approximately 250 degrees is reached), and then drops (along W3 indicated by a long dashed double-short dashed line in FIG. 7B and W4 indicated by a long dashed short dashed line in FIG. 7B). When the workpiece W makes the fifth rotation (along W5 from time t15 to t16 in FIG. 7A), the grinding resistance moment Mn rises to a value Mn5 larger than the peak value Mn4 of the grinding resistance moment Mn in the fourth rotation (until a rotational angle of approximately 270 degrees is reached), and then settles (at W5 indicated by a continuous line in FIG. 7B).

Figure 8A:
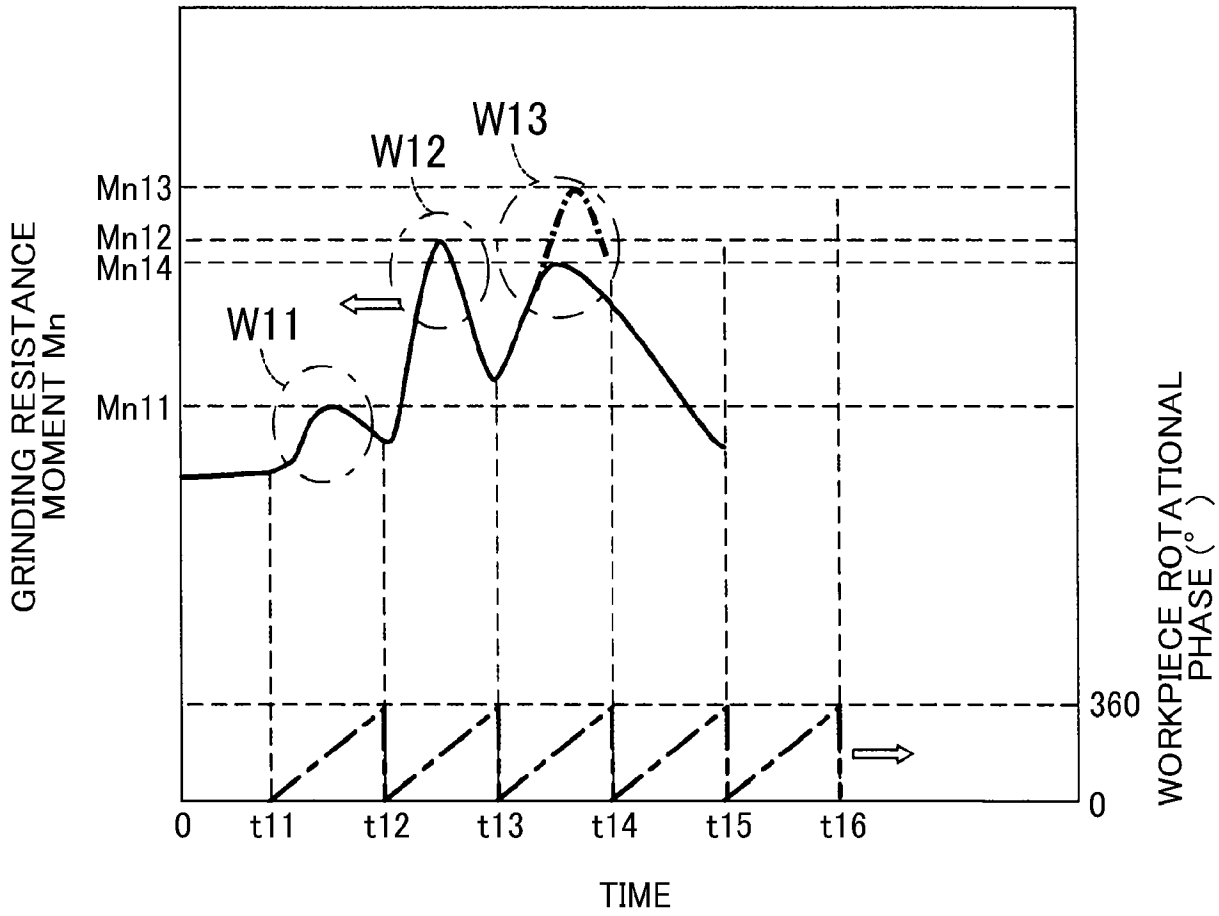
FIG. 8A is a diagram illustrating the temporal change in the grinding resistance moment for each rotation of the workpiece when slip occurs.
Figure 8B:
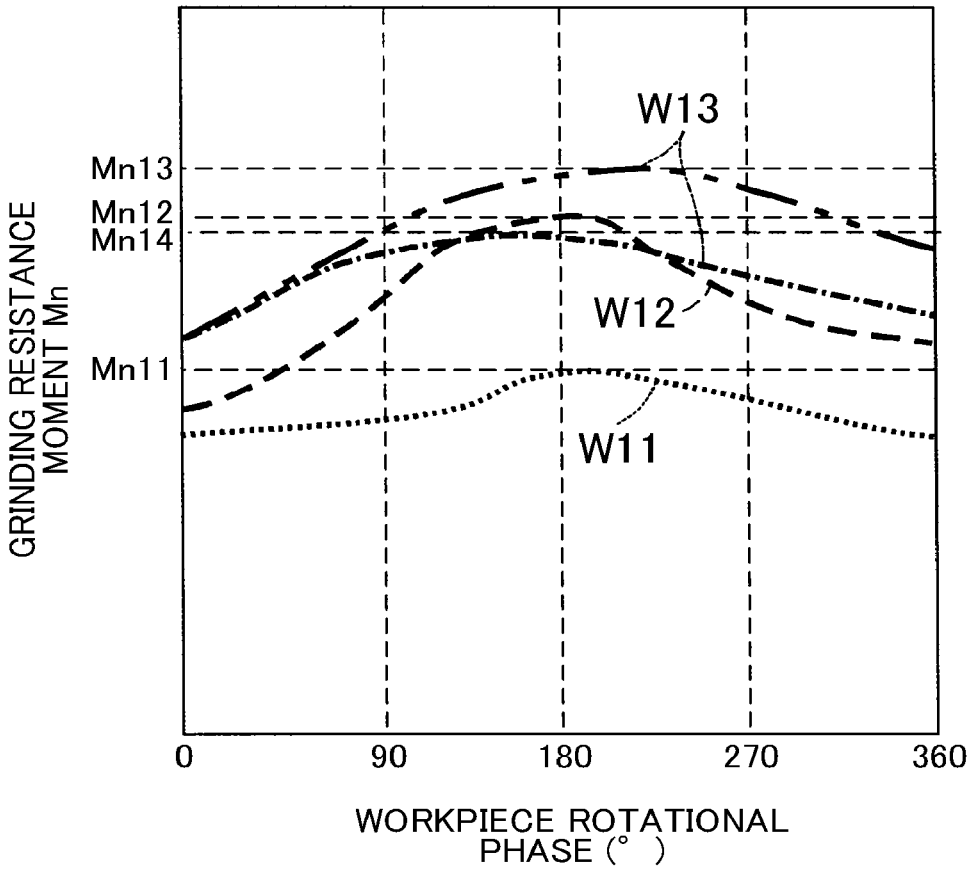
FIG. 8B is a diagram illustrating the temporal change in the grinding resistance moment for each rotational phase (angle) of the workpiece when the slip occurs.

The following describes the temporal change in the grinding resistance moment Mn for each rotation and for each rotational phase (angle) of the workpiece W when the slip occurs. As illustrated in FIGS. 8A and 8B, when the workpiece W makes the first rotation (along W11 from time t11 to t12 in FIG. 8A), the grinding resistance moment Mn once rises (until a rotational angle of approximately 180 degrees is reached), and then drops (along W11 indicated by a dotted line in FIG. 8B). When the workpiece W makes the second rotation (along W12 from time t12 to t13 in FIG. 8A), the amount of infeed increases, and thus, the actual infeed amount per unit time increases. Consequently, the grinding resistance moment Mn once rises to a value Mn12 larger than a peak value Mn11 of the grinding resistance moment Mn in the first rotation (until a rotational angle of approximately 180 degrees is reached), and then drops (along W12 indicated by a dashed line in FIG. 8B).

When the workpiece W makes the third rotation (along W13 from time t13 to t14 in FIG. 8A), if the slip does not occur, the amount of infeed will increase, and thus, the actual infeed amount per unit time will increase. Consequently, the grinding resistance moment Mn will once rise to a value Mn13 larger than the peak value Mn12 of the grinding resistance moment Mn in the second rotation (until a rotational angle of approximately 220 degrees is reached), and will then drop (along W13 indicated by a long dashed double-short dashed line in FIG. 8B). However, since the slip has occurred when the workpiece W makes the third rotation, the grinding resistance moment Mn once rises to a value Mn14 smaller than the peak value Mn12 of the grinding resistance moment Mn in the second rotation (until a rotational angle of approximately 160 degrees is reached), and then drops (along W13 from time t13 to t14 in FIG. 8A, and along W13 indicated by a long dashed short dashed line in FIG. 8B).

As described above, even if the run-out of the outer circumference of the workpiece W is present with respect to the center holes, and thus, the grinding resistance moment Mn fluctuates from a lower value to a higher value and from the higher value to the lower value during one rotation of the workpiece W, the grinding resistance moment Mn is compared at the same phase (angle) on a per rotation basis of the workpiece W. Consequently, the slip can be determined to have occurred without being affected by the above-described run-out. That is, if the grinding resistance moment Mn at the current rotational phase (angle) of the workpiece W is lower than the grinding resistance moment Mn at the same phase (angle) as the current rotational phase (angle) at the previous time (such as one rotation before), the slip can be determined to have occurred. The following describes an operation of the grinding apparatus 1 that uses such a determination method.

The following describes the operation of the grinding apparatus 1 in the present embodiment with reference to the drawings. First, the control device 30 starts to rotate the workpiece W and the grinding wheel 23 (Step S1 in FIG. 2A), and starts the idle grinding operation (Step S2 in FIG. 2A). That is, the control device 30 moves the grinding wheel 23 forward in the X-axis direction toward the workpiece W (Step S11 in FIG. 2B).

Figure 2A:
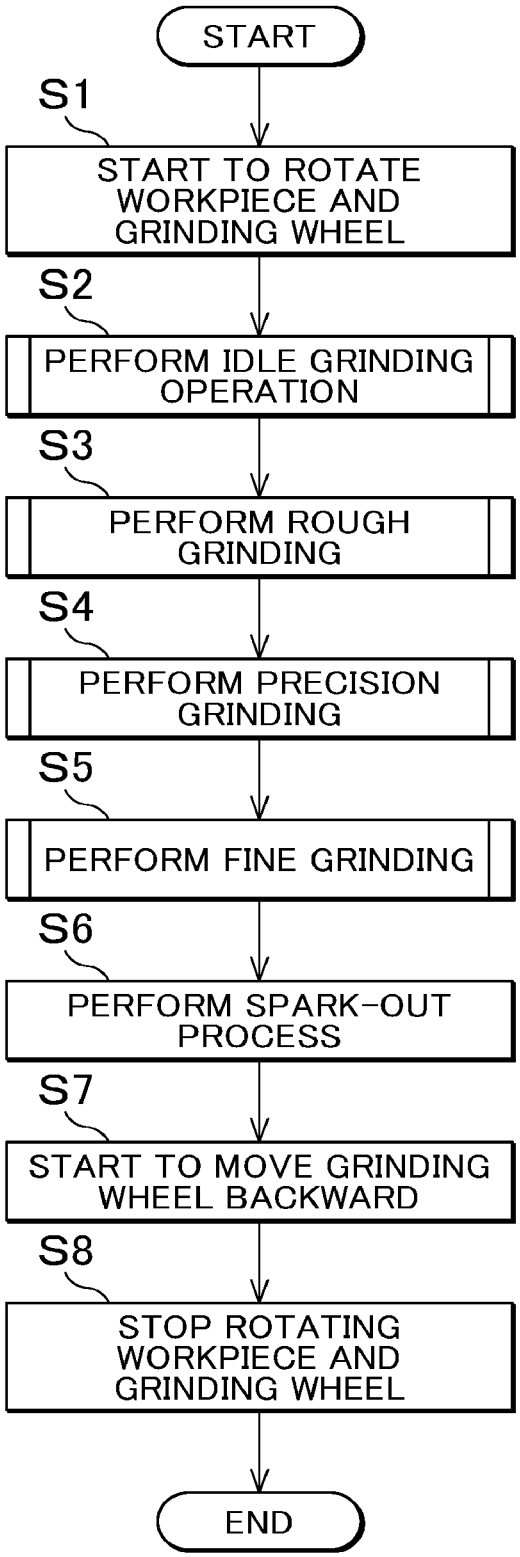
FIG. 2A is a flowchart for explaining an operation of the grinding apparatus.
Figure 2B:
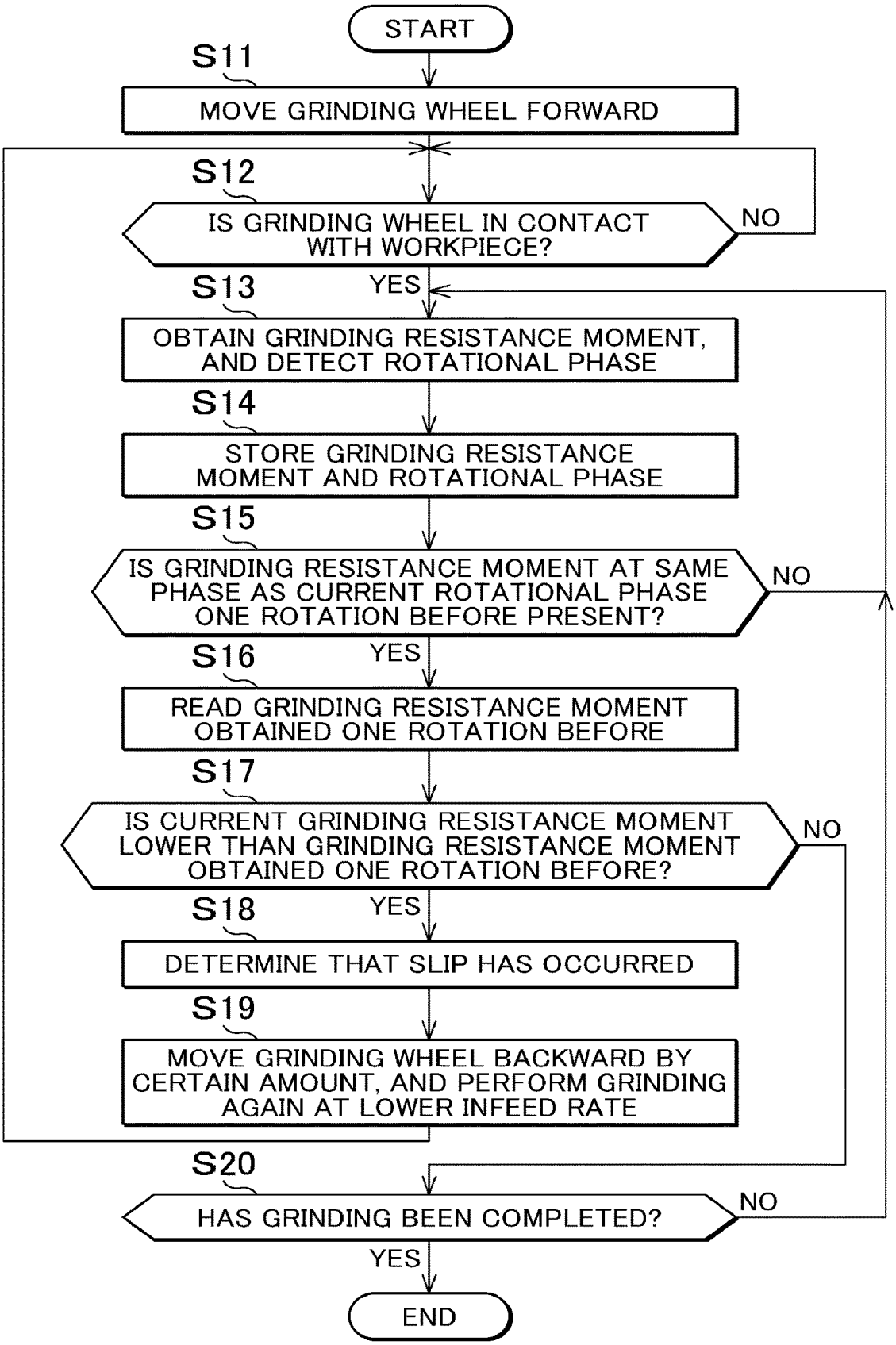
FIG. 2B is a flowchart for explaining a detailed operation of FIG. 2A.

Specifically, the processing controller 35 controls the operations of the master servo motor 16, the slave servo motor 20, and the wheel spindle drive motor 25 to start to rotate the workpiece W and the grinding wheel 23, and controls the operation of the X-axis servo motor 22 to start to move the grinding wheel 23 forward in the X-axis direction toward the workpiece W. The processing at Step S12 and later in FIG. 2B is performed in the idle grinding operation. However, since the grinding is not performed in the idle grinding operation, the processing at Step S12 and later in FIG. 2B will be described in detail in the description of the subsequent rough grinding (Step S3 in FIG. 2A).

The control device 30 starts to move the grinding wheel 23 forward in the X-axis direction toward the workpiece W (Step S11 in FIG. 2B), and detects acoustic emission (AE) waves emitted by the grinding wheel 23 with a contact detection sensor (AE sensor) (not illustrated) to determine whether the grinding wheel 23 has come in contact with the workpiece W (Step S12 in FIG. 2B). If the grinding wheel 23 is determined to have come in contact with the workpiece W, the control device 30 detects the drive current signal of the wheel spindle drive motor 25 to obtain the grinding resistance moment Mn, and detects the rotational phase (Step S13 in FIG. 2B, i.e., a first detection step and a second detection step).

Specifically, if a contact detection signal of the contact detection sensor has exceeded a threshold set in advance, the second detection unit 32 detects the drive current signal of the wheel spindle drive motor 25, and obtains the grinding resistance moment Mn corresponding to the detected drive current signal with reference to the table. If the contact detection signal of the contact detection sensor has exceeded the threshold set in advance, the first detection unit 31 detects the phase detection signal from the rotary encoder 16*a* of the master servo motor 16. The first detection unit 31 detects the rotational phase (from 0 degrees to 360 degrees) of the workpiece W after the contact detection signal has exceeded the threshold set in advance.

The control device 30 stores the obtained grinding resistance moment Mn (or drive current signal) and the detected rotational phase, and at the same time, automatically deletes the grinding resistance moment Mn (or drive current signal) and the rotational phase obtained two rotations before (Step S14 in FIG. 2B, i.e., a storage step). The control device 30 determines the presence or absence of the grinding resistance moment Mn (or drive current signal) obtained at the same phase as the current rotational phase one rotation before (Step S15 in FIG. 2B, i.e., a determination step), and, since the grinding resistance moment Mn (or drive current signal) obtained one rotation before is not stored in the case of the first rotation, the control device 30 returns the process to Step S13 to repeat the above-described processing.

If, at Step S15, the grinding resistance moment Mn (or drive current signal) obtained one rotation before is determined to be present, the control device 30 reads the grinding resistance moment Mn (or drive current signal) obtained one rotation before (Step S16 in FIG. 2B, i.e., the determination step). The control device 30 determines whether the current grinding resistance moment Mn (or drive current signal) is lower than the grinding resistance moment Mn (or drive current signal) obtained one rotation before (Step S17 in FIG. 2B, i.e., the determination step). If not, the control device 30 determines whether the rough grinding has been completed (Step S20 in FIG. 2B), and if not, the control device 30 returns the process to Step S13 to repeat the above-described processing.

If, at Step S17, the current grinding resistance moment Mn (or drive current signal) is determined to be lower than the grinding resistance moment Mn (or drive current signal) obtained one rotation before, the control device 30 determines that the slip has occurred (Step S18 in FIG. 2B, i.e., the determination step), and the control device 30 moves the grinding wheel 23 backward by a certain amount, and performs the grinding again with the infeed rate set to a lower rate (Step S19 in FIG. 2B). The control device 30 returns the process to Step S12 to repeat the above-described processing.

Specifically, if the current grinding resistance moment Mn (or drive current signal) received from the second detection unit 32 is determined to be lower than the grinding resistance moment Mn (or drive current signal) one rotation before read from the storage unit 33, the determination unit 34 determines the slip has occurred, and transmits a slip occurrence signal to the processing controller 35. After receiving the slip occurrence signal from the determination unit 34, the processing controller 35 controls the operation of the X-axis servo motor 22 to move the grinding wheel 23 backward in the X-axis direction by the certain amount from the workpiece W, and to move the grinding wheel 23 forward at a reduced forward speed obtained by multiplying the infeed rate of the grinding wheel 23 in the X-axis direction toward the workpiece W by an override value, and performs the grinding again. For example, when multiplied by an override value of 0.8, the infeed rate is reduced by 20%.

If, at Step S20, the rough grinding is determined to have been completed, the control device 30 performs the subsequent precision grinding (Step S4 in FIG. 2A), subsequently performs the fine grinding (Step S5 in FIG. 2A), and further performs the spark-out process (Step S6 in FIG. 2A).

If the spark-out process is determined to have been completed, the control device 30 starts to move the grinding wheel 23 backward in the X-axis direction from the workpiece W (Step S7 in FIG. 2A), stops the rotation of the workpiece W and the grinding wheel 23 (Step S8 in FIG. 2A), and ends the whole processing.

Specifically, the processing controller 35 controls the operation of the X-axis servo motor 22 to start to move the grinding wheel 23 backward in the X-axis direction from the workpiece W, and controls the operations of the master servo motor 16, the slave servo motor 20, and the wheel spindle drive motor 25 to stop the rotation of the workpiece W and the grinding wheel 23.

In the embodiment described above, if the current grinding resistance moment Mn is determined to be lower than the grinding resistance moment Mn obtained one rotation before, the control device 30 determines that the slip has occurred. However, the grinding resistance moment Mn decreases because the grinding amount of the workpiece W decreases as the diameter thereof is reduced by the grinding. Thus, the control device 30 may determine the occurrence of the slip taking into account this amount of reduction in the grinding resistance moment Mn.

Specifically, the storage unit 33 stores in advance a constant smaller than one obtained based on the amount of reduction in the grinding resistance moment Mn. The determination unit 34 reads the grinding resistance moment Mn obtained one rotation before and the above-described constant from the storage unit 33, and compares the current grinding resistance moment Mn received from the second detection unit 32 with a corrected grinding resistance moment Mn obtained by multiplying the grinding resistance moment Mn obtained one rotation before by the above-described constant, and, if the current grinding resistance moment Mn is lower than the corrected grinding resistance moment Mn, the determination unit 34 determines that the slip has occurred.

In the embodiment described above, the grinding apparatus 1 is configured to transmit the rotation to the workpiece W via the centers 14 and 18. However, provided that the holding unit transmits the rotation to the workpiece W with a frictional force, the occurrence of the slip can be determined even if the rotation is configured to be transmitted, for example, via the chuck gripping the outer circumference of the workpiece W with three claws, or via the work carry making set screws abut on the outer circumference of the workpiece W.

In the embodiment described above, the second detection unit 32 detects the drive current signal from the wheel spindle drive motor 25, and obtains the grinding resistance moment Mn corresponding to the detected drive current signal with reference to the table. Alternatively, the second detection unit 32 may store in advance a table representing a relation between a drive current signal of the master servo motor 16 or the slave servo motor 20 and the grinding resistance moment Mn that have been measured in advance, detect the drive current signal of the master servo motor 16 or the slave servo motor 20, and obtain the grinding resistance moment Mn corresponding to the detected drive current signal with reference to the table.

Also alternatively, the grinding apparatus 1 may be provided with an acoustic emission (AE) sensor near the grinding wheel 23 or the workpiece W, and the second detection unit 32 may store in advance a table representing a relation between an elastic wave received from the AE sensor and the grinding resistance moment Mn that have been measured in advance, detect the elastic wave from the AE sensor, and obtain the grinding resistance moment Mn corresponding to the elastic wave detected from the AE sensor with reference to the table.

Still alternatively, the grinding apparatus 1 may be provided with a strain gauge at the center 14 or the center 18, and the second detection unit 32 may store in advance a table representing a relation between a strain obtained from a detection signal of the strain gauge and the grinding resistance moment Mn that have been measured in advance, receive the detection signal of the strain gauge and convert it into the strain, and obtain the grinding resistance moment Mn corresponding to the converted strain with reference to the table.

While a tangential grinding resistance is detected from the wheel spindle drive motor 25 or the master servo motor 16, the tangential grinding resistance and a normal grinding resistance are detected from the AE sensor and the strain gauge. However, the tangential grinding resistance and the normal grinding resistance have a proportional relation, and therefore, do not adversely affect the determination of the slip.

Figure 9A:
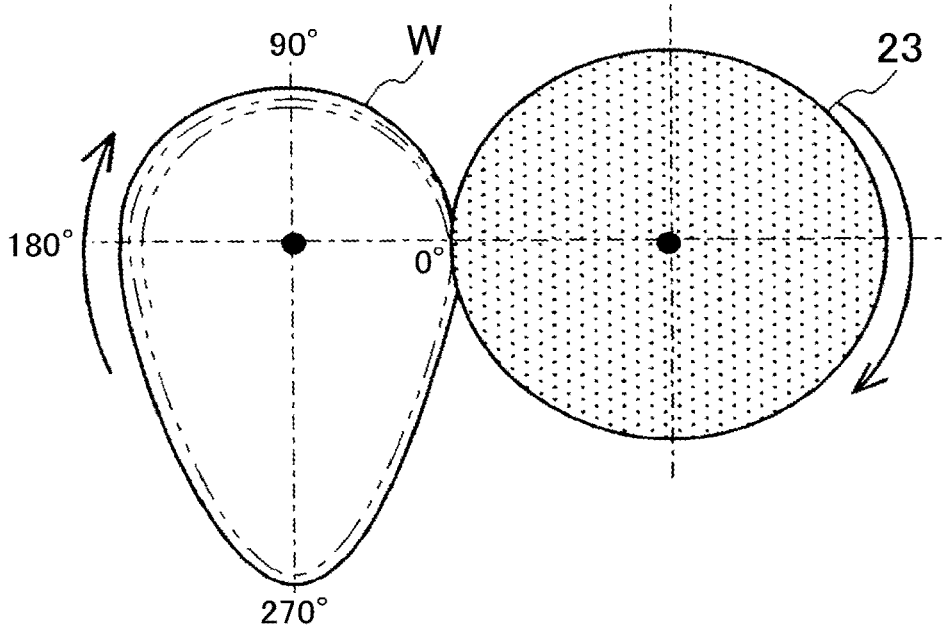
FIG. 9A is a diagram illustrating the workpiece and the grinding wheel in the grinding process using a stepped cycle performed in the grinding apparatus.
Figure 9B:
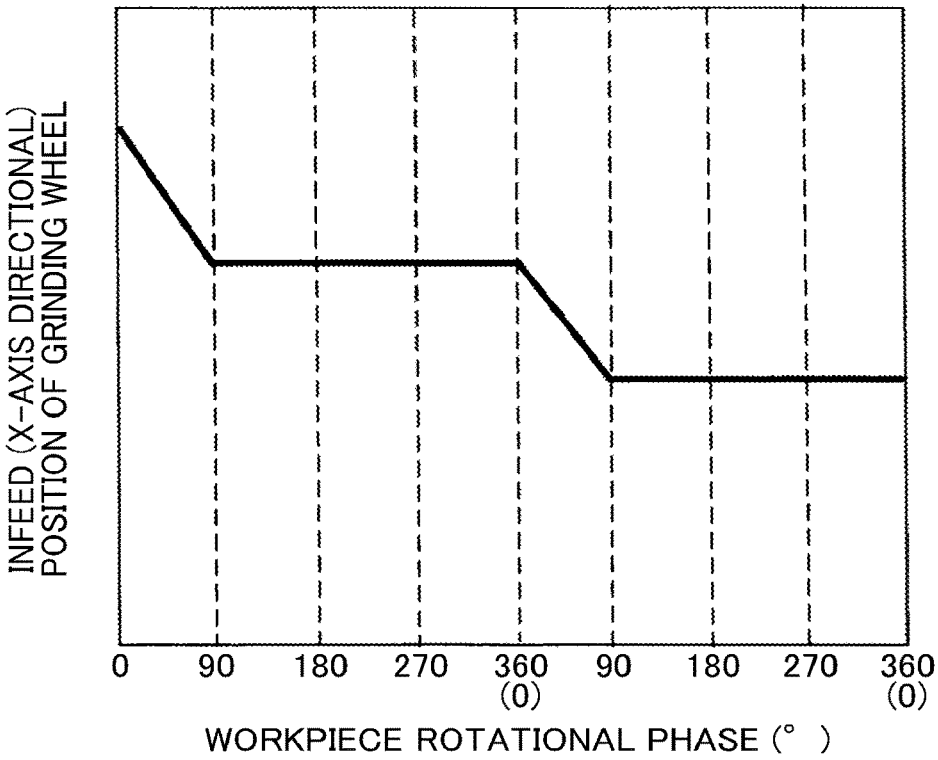
FIG. 9B is a diagram illustrating a relation between the infeed position of the grinding wheel and the rotational phase of the workpiece in the grinding process using the stepped cycle performed in the grinding apparatus.
Figure 10A:
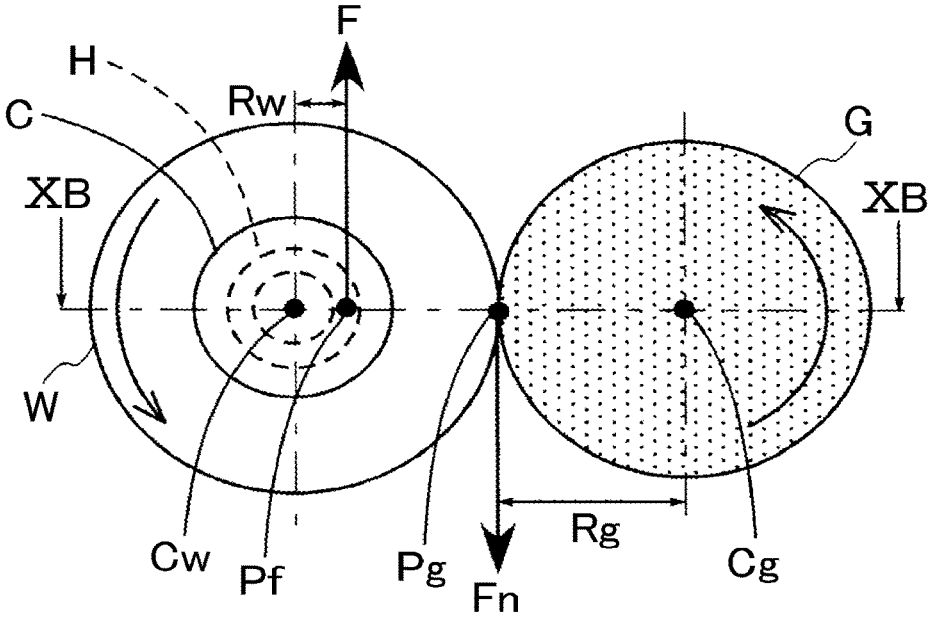
FIG. 10A is a diagram illustrating the workpiece and the grinding wheel for explaining the grinding resistance moment in the grinding process.
Figure 10B:
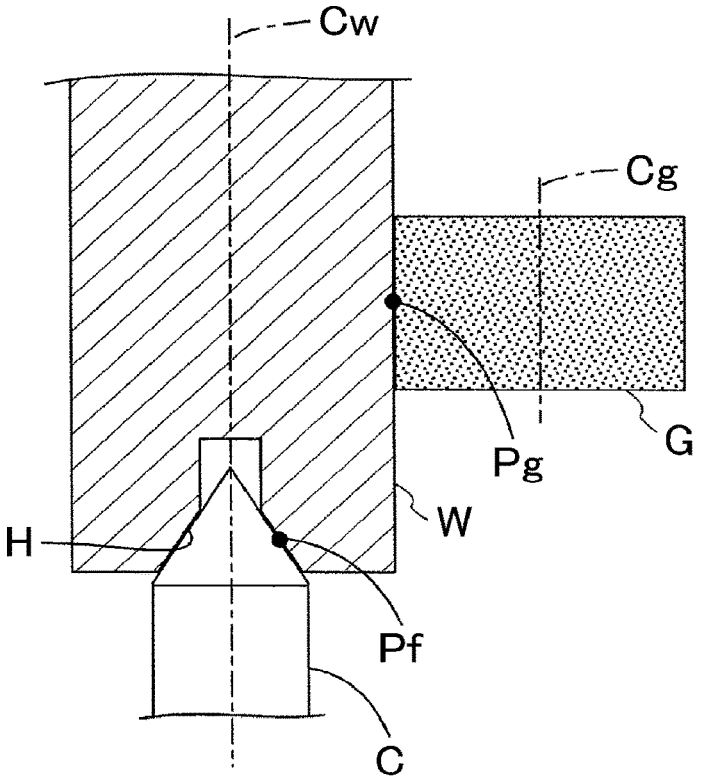
FIG. 10B is an XB-XB sectional view of FIG. 10A.

The embodiment above has been described by way of the grinding process in which, as illustrated in FIG. 3A, the workpiece W having a circular section is ground using the spiral cycle, that is, the cycle in which the infeed position (in the X-axis direction) of the grinding wheel 23 has a proportional relation with the rotational phase (angle) of the workpiece W, as illustrated in FIG. 3B. Alternatively, the occurrence of the slip can be determined in the grinding process in which, as illustrated in FIG. 9A, the workpiece W having a non-circular (cam-shaped) section is ground using a stepped cycle, that is, a cycle in which, as illustrated in FIG. 9B, the grinding wheel 23 grinds the workpiece W by staying closer thereto in a predetermined rotational phase range (from 0 degrees to 180 degrees), that is, in a cylindrical portion having an equal diameter, and the grinding wheel 23 is moved forward/backward and stopped with respect to the workpiece W based on lift data in a rotational phase range other than the predetermined rotational phase range (from 180 degrees to 360 degrees (0 degrees)), that is, a cam portion.

In the embodiment described above, after receiving the slip occurrence signal from the determination unit 34, the processing controller 35 controls the operation of the X-axis servo motor 22 to move the grinding wheel 23 backward in the X-axis direction by the certain amount from the workpiece W, and to move the grinding wheel 23 forward at a reduced forward speed in the X-axis direction toward the workpiece W, and performs the grinding again. Alternatively, after receiving the slip occurrence signal from the determination unit 34, the processing controller 35 may stop the grinding, or may continue the grinding with the grinding wheel 23 at a reduced forward speed in the X-axis direction toward the workpiece W.

The grinding apparatus 1 of the present embodiment grinds the workpiece W by rotating the workpiece W held by the main spindles Cm and Cs and the grinding wheel 23 held by the wheel spindle 24, and by relatively moving the grinding wheel 23 toward and away from the workpiece W. The grinding apparatus 1 includes the first detection unit 31 that detects the rotational phase of the workpiece W; the second detection unit 32 that detects the grinding resistance moment Mn at the grinding point between the grinding wheel 23 and the workpiece W, or detects the drive current of the rotary drive unit (the master servo motor 16 or the slave servo motor 20) of the workpiece W or the rotary drive unit (the wheel spindle drive motor 25) of the grinding wheel 23; the storage unit 33 that stores the grinding resistance moment Mn or the drive current in a manner associated with the rotational phase; and the determination unit 34 that determines the slip between the workpiece W and the main spindles Cm and Cs based on the grinding resistance moment Mn or the drive current at the current rotational phase, and on the grinding resistance moment Mn or the drive current at the same phase as the current rotational phase of the previous time.

In the grinding operation, when the grinding wheel 23 held on the wheel spindle stock 21 is infed into the workpiece W at a constant feed rate of the wheel spindle stock 21, the grinding resistance moment Mn or the drive current for each rotational angle of the workpiece W tends to rise before settling and tends to remain at the same level after settling, if the slip does not occur between the workpiece W and the main spindles Cm and Cs. Since the grinding apparatus 1 of the present embodiment monitors the grinding resistance moment Mn or the drive current for each rotational phase (angle) of the workpiece W, the occurrence of the slip between the workpiece W and the main spindles Cm and Cs can be reliably determined. Consequently, a defective product of the workpiece W can be prevented from flowing out, and the safety margin for the grinding conditions can be reduced to shorten the machining time.

If the grinding wheel 23 and the main spindles Cm and Cs relatively move at a constant speed, the determination unit 34 compares the current grinding resistance moment Mn or the current drive current with the previous grinding resistance moment Mn or the previous drive current, and, if the current grinding resistance moment Mn or the current drive current is lower than the previous grinding resistance moment Mn or the previous drive current, determines that the slip has occurred between the workpiece W and the main spindles Cm and Cs. This operation can distinguish the reduction in the grinding resistance moment Mn or the current drive current from that caused by the run-out of the workpiece W during the grinding, and can thus reliably determine the occurrence of the slip between the workpiece W and the main spindles Cm and Cs.

If the grinding wheel 23 and the main spindles Cm and Cs relatively move at a constant speed, the determination unit 34 compares the current grinding resistance moment Mn or the current drive current with a corrected grinding resistance moment Mn or a corrected drive current obtained by multiplying the previous grinding resistance moment Mn or the previous drive current by a constant smaller than one, and, if the current grinding resistance moment Mn or the current drive current is lower than the corrected grinding resistance moment Mn or the corrected drive current, determines that the slip has occurred between the workpiece W and the main spindles Cm and Cs. Although the grinding resistance moment Mn or the drive current decreases because the grinding amount of the workpiece W decreases as the diameter thereof is reduced by the grinding, using the corrected grinding resistance moment Mn or the corrected drive current enables reliable determination of the occurrence of the slip between the workpiece W and the main spindles Cm and Cs.

The second detection unit 32 detects the elastic wave emitted from the workpiece W or the grinding wheel 23, and detects the grinding resistance moment Mn based on the detected elastic wave, or the second detection unit 32 detects the strain of the holding unit (the center 14 or the center 18) holding the workpiece W, and detects the grinding resistance moment Mn based on the detected strain. These operations can also determine the occurrence of the slip between the workpiece W and the main spindles Cm and Cs.

The grinding apparatus 1 includes the holding unit (the center 14 or 18, the chuck, or the work carry) that holds the workpiece W and transmits the rotation thereto with a frictional force, and can thus determine the slip between the workpiece W and the holding unit (the center 14 or 18, the chuck, or the work carry).

The grinding apparatus 1 grinds the workpiece W by infeeding the grinding wheel 23 into the workpiece W in the predetermined rotational phase range in one rotation of the workpiece W, by stopping infeeding the grinding wheel 23 into the workpiece W in the rotational phase range other than the predetermined rotational phase range, and by moving the grinding wheel 23 forward/backward based on the cam shape. This operation can determine the occurrence of the slip between the workpiece W and the main spindles Cm and Cs even when the workpiece W has a non-circular (cam-shaped) section.

A grinding method for grinding the workpiece W by rotating the workpiece W held by the main spindles Cm and Cs and the grinding wheel 23 held by the wheel spindle 24, and by relatively moving the grinding wheel 23 toward and away from the workpiece W according to the present configuration includes the first detection step of detecting the rotational phase of the workpiece W; the second detection step of detecting the grinding resistance moment Mn at the grinding point between the grinding wheel 23 and the workpiece W, or detecting the drive current of the rotary drive unit (the master servo motor 16 or the slave servo motor 20) of the workpiece W or the rotary drive unit (the wheel spindle drive motor 25) of the grinding wheel 23; the storage step of storing the grinding resistance moment Mn or the drive current in a manner associated with the rotational phase; and the determination step of determining the slip between the workpiece W and the main spindles Cm and Cs based on the grinding resistance moment Mn or the drive current at the current rotational phase, and on the grinding resistance moment Mn or the drive current at the same phase as the current rotational phase of the previous time. According to the grinding method of the present invention, the same effects as the effects of the grinding apparatus 1 described above can be obtained.

What is claimed is:

1. A grinding apparatus to grind a workpiece by rotating the workpiece held by main spindles and a grinding wheel held by a wheel spindle, and by relatively moving the grinding wheel toward and away from the workpiece, the grinding apparatus comprising:

a first detector configured to detect a rotational phase of the workpiece during grinding;

a second detector configured to detect a grinding resistance moment at a grinding point between the grinding wheel and the workpiece during grinding;

a storage unit configured to store the grinding resistance moment in a manner associated with the detected, rotational phase; and a determination unit configured to determine a slip between the workpiece and the main spindles, based on:

the detected grinding resistance moment at a current rotational phase during grinding, and on the grinding resistance moment at the same rotational phase as the current rotational phase at a previous time during grinding.

2. The grinding apparatus according to claim 1, wherein, when the grinding wheel and the main spindles relatively move at a constant speed, the determination unit is configured to compare the current grinding resistance moment with the previous grinding resistance moment, and, when the current grinding resistance moment is lower than the previous grinding resistance moment, to determine that the slip has occurred between the workpiece and the main spindles.

3. The grinding apparatus according to claim 1, wherein, when the grinding wheel and the main spindles relatively move at a constant speed, the determination unit is configured to compare the current grinding resistance moment with a corrected grinding resistance moment obtained by multiplying the previous grinding resist, moment by a constant smaller than one, and, when the current grinding resistance moment is lower than the corrected grinding resistance moment, to determine that the slip has occurred between the workpiece and the main spindles.

4. The grinding apparatus according to claim 1, wherein the second detector is configured to detect an elastic wave emitted from the workpiece or the grinding wheel, and to detect the grinding resistance moment based on the detected elastic wave.

5. The grinding apparatus according to claim 1, wherein the second detector is configured to detect a strain of a holding unit holding the workpiece, and to detect the grinding resistance moment based on the detected strain.

6. The grinding apparatus according to claim 1, further comprising a holding unit configured to hold the workpiece, and to transmit the rotation thereto with a frictional force.

7. The grinding apparatus according to claim 1, wherein the grinding apparatus is configured to grind the workpiece by infeeding the grinding wheel into the workpiece in a predetermined rotational phase range in one rotation of the workpiece, and by stopping infeeding the grinding wheel into the workpiece in a rotational phase range other than the predetermined rotational phase range.

8. A grinding method for grinding a workpiece by rotating the workpiece held by main spindles and a grinding wheel held by a wheel spindle, and by relatively moving the grinding wheel toward and away from the workpiece, the grinding method comprising:

a first detection step of detecting a rotational phase of the workpiece during grinding;

a second detection step of detecting a grinding resistance moment at a grinding point between the grinding wheel and the workpiece during grinding;

a storage step of storing the detected grinding resistance moment in a manner associated with the rotational phase; and a determination step of determining a slip between the workpiece and the main spindles based on the detected grinding resistance moment at a current rotational phase during grinding, and on the grinding resistance moment at the same rotational phase as the current rotational phase at a previous time during grinding.

* * * * *